US010415129B2

(12) United States Patent
Danielou et al.

(10) Patent No.: US 10,415,129 B2
(45) **Date of Patent: *Sep. 17, 2019**

(54) METHOD FOR MANUFACTURING PRODUCTS MADE OF ALUMINUM-COPPER-LITHIUM ALLOY WITH IMPROVED FATIGUE PROPERTIES, AND DISTRIBUTOR FOR THIS METHOD

(71) Applicant: CONSTELLIUM ISSOIRE, Issoire (FR)

(72) Inventors: Armelle Danielou, Les Echelles (FR); Soizic Blais, Saint Etienne de Crossey (FR); Philippe Jarry, Grenoble (FR); Olivier Ribaud, Renage (FR); Bernard Valentin, Voiron (FR)

(73) Assignee: CONSTELLIUM ISSOIRE, Issoire (FR)

( * ) Notice: Subject to any disclaimer, the term of this patent is extended or adjusted under 35 U.S.C. 154(b) by 344 days.

This patent is subject to a terminal disclaimer.

(21) Appl. No.: 15/102,965

(22) PCT Filed: Dec. 11, 2014

(86) PCT No.: PCT/FR2014/000273

§ 371 (c)(1),
(2) Date: Jun. 9, 2016

(87) PCT Pub. No.: WO2015/086922

PCT Pub. Date: Jun. 18, 2015

(65) Prior Publication Data

US 2016/0355916 A1 Dec. 8, 2016

(30) Foreign Application Priority Data

Dec. 13, 2013 (FR) ..... 13 02932

(51) Int. Cl.

| | |
|---|---|
| ***C22F 1/057*** | (2006.01) |
| ***C22C 21/16*** | (2006.01) |
| ***C22C 21/14*** | (2006.01) |
| ***C22C 1/02*** | (2006.01) |
| ***B22D 11/00*** | (2006.01) |
| ***B21J 5/00*** | (2006.01) |
| ***B22D 11/059*** | (2006.01) |
| ***B22D 11/04*** | (2006.01) |
| ***B22D 21/00*** | (2006.01) |
| ***B21B 1/22*** | (2006.01) |
| ***B21C 23/21*** | (2006.01) |
| ***C22C 21/18*** | (2006.01) |
| ***B22D 11/041*** | (2006.01) |
| ***C22C 21/12*** | (2006.01) |
| *B21B 3/00* | (2006.01) |

(52) U.S. Cl.

CPC ..... *C22F 1/057* (2013.01); *B21B 1/22* (2013.01); *B21C 23/212* (2013.01); *B21J 5/00* (2013.01); *B22D 11/003* (2013.01); *B22D 11/041* (2013.01); *B22D 11/0408* (2013.01); *B22D 11/059* (2013.01); *B22D 21/007* (2013.01); *C22C 1/026* (2013.01); *C22C 21/12* (2013.01); *C22C 21/14* (2013.01); *C22C 21/16* (2013.01); *C22C 21/18* (2013.01); *B21B 2003/001* (2013.01)

(58) Field of Classification Search

CPC ... B21B 1/22; B21B 2003/001; B21C 23/212; B21J 5/00; B22D 11/003; B22D 11/0408; B22D 11/041; B22D 11/059; B22D 21/007; C22C 1/026; C22C 21/12; C22C 21/14; C22C 21/16; C22C 21/18; C22F 1/057

See application file for complete search history.

(56) References Cited

U.S. PATENT DOCUMENTS

| | | | |
|---|---|---|---|
| 4,769,158 A | 9/1988 | Eckert | |
| 5,032,359 A | 7/1991 | Pickens | |
| 5,207,974 A | 5/1993 | Yun | |
| 5,383,986 A | 1/1995 | Cho et al. | |
| 5,415,220 A | 5/1995 | Edwards et al. | |
| 5,871,660 A | 2/1999 | Xu et al. | |
| 6,270,717 B1 | 8/2001 | Tremblay et al. | |
| 8,365,808 B1 | 2/2013 | Tilak | |
| 2004/0084172 A1* | 5/2004 | Vincent | B22C 9/082 164/437 |
| 2007/0215310 A1 | 9/2007 | Van Schooneveldt et al. | |

(Continued)

FOREIGN PATENT DOCUMENTS

| | | |
|---|---|---|
| CN | 201077859 Y | 6/2008 |
| EP | 1504834 A1 | 2/2005 |

(Continued)

OTHER PUBLICATIONS

International Search Report from corresponding FR 1302932.

(Continued)

*Primary Examiner* — Jenny R Wu

(74) *Attorney, Agent, or Firm* — McBee Moore Woodward & Vanik IP, LLC

(57) ABSTRACT

The invention relates to a method for manufacturing an aluminum alloy product including the steps of: creating a bath of liquid metal in an aluminum-copper-lithium alloy, casting said alloy by vertical semi-continuous casting so as to obtain a plate with thickness T and width W such that, during solidification, the hydrogen content of said liquid metal bath (1) is lower than 0.4 ml/100 g, the oxygen content above the liquid surface (14, 15) is less than 0.5% by volume.

18 Claims, 6 Drawing Sheets

(56) References Cited

U.S. PATENT DOCUMENTS

| | | | | |
|---|---|---|---|---|
| 2009/0142222 | A1 | 6/2009 | Colvin et al. | |
| 2011/0030856 | A1 | 2/2011 | Warner | |
| 2011/0029801 | A1 | 9/2011 | Warner et al. | |
| 2012/0152415 | A1 | 6/2012 | Danielou et al. | |
| 2016/0160320 | A1* | 6/2016 | Brandt | C22B 21/04 164/460 |

FOREIGN PATENT DOCUMENTS

| | | | |
|---|---|---|---|
| FR | 2757422 | A1 | 12/1996 |
| WO | 199944719 | A2 | 1/1999 |
| WO | 2015086922 | A2 | 6/2015 |

OTHER PUBLICATIONS

International Search Report dated Jul. 10, 2015, issued in counterpart Application No. PCT/FR2014/000273.
International Search Report Issued in PCT/FR2014/000271, dated Dec. 11, 2014.
Standard Purchase Order Supplied by Textile Product Inc to ALCOA Technology, Printed Sep. 4, 2007, pp. 1-8.
"LENO Weave", Wikipedia Page, Retrieved Jun. 19, 2019, pp. 1-2.
"Carbon Fibers", Wikipedia Page, Retrieved Jun. 11, 2019, pp. 1-5.
ASM Specialty Handbook, Aliumium and Aliuminum Alloys, ASM International (1993) p. 7.
"Molten Aluminum Processing and Casting" ASM Specialty Handbook, ASM International, (1993), pp. 199-210.

* cited by examiner

METHOD FOR MANUFACTURING PRODUCTS MADE OF ALUMINUM-COPPER-LITHIUM ALLOY WITH IMPROVED FATIGUE PROPERTIES, AND DISTRIBUTOR FOR THIS METHOD

CROSS REFERENCE TO RELATED APPLICATIONS

This application is a § 371 National Stage Application of PCT/FR2014/000273, filed Dec. 11, 2014, which claims priority to FR 13/02932, filed Dec. 13, 2013.

BACKGROUND

The invention relates to wrought aluminum-copper-lithium alloy products, and particularly to such products and methods for their manufacture and use, especially for aircraft and aerospace construction.

DESCRIPTION OF RELATED ART

Rolled aluminium alloy products are developed to produce structural elements for the aircraft industry and the aerospace industry in particular.

Aluminium-copper-lithium alloys are particularly promising for the manufacture of this type of product. The specifications imposed by the aircraft industry for fatigue resistance are demanding. For thick products, it is particularly difficult to attain these specifications. Because of the possible thicknesses of cast slabs, the reduction in thickness by hot working is quite low and therefore the sites related to casting on which fatigue cracks begin do not get smaller during hot working.

As lithium is particularly susceptible to oxidation, casting of aluminium-copper-lithium alloys generally generates more sites on which fatigue cracking begins than for alloys of type 2XXX without lithium or 7XXX. The solutions usually found for obtaining thick rolled products made of alloys of type 2XXX without lithium or 7XXX do not give adequate fatigue properties for aluminium-lithium-copper alloys.

Thick products made of Al—Cu—Li alloys are notably described in applications US2005/0006008 and US2009/0159159.

In application WO2012/110717, it is proposed, in order to improve the properties, especially fatigue properties, of aluminium alloys containing in particular at least 0.1% Mg and/or 0.1% Li, to perform ultrasound treatment during casting. But this type of treatment is difficult to carry out for the quantities necessary for the manufacture of thick plates.

There is a need for thick aluminium-copper-lithium alloy products having improved properties compared to those of known products, particularly in terms of fatigue properties, while having advantageous fracture toughness and static mechanical strength properties. In addition there is a need for a simple and economical method of obtaining these products.

SUMMARY

A first object of the invention is a method of manufacturing an aluminum alloy product comprising steps in which (a) a bath of molten alloy metal is prepared comprising, as a percentage by weight, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others≤0.05 each and ≤0.15 in total, (b) said alloy is cast by vertical semi-continuous casting to obtain a slab of thickness T and width W so that upon solidification, the hydrogen content of said molten metal bath (1) is less than 0.4 ml/100 g, the oxygen content measured above the liquid surface (14, 15) is less than 0.5% by volume, the distributor device (7) used for casting is made of fabric comprises essentially carbon; it comprises a lower face (76), an upper face defining the opening through which the molten metal is introduced (71) and a wall of substantially rectangular section, the wall comprising two longitudinal portions parallel with width W (720, 721) and two transverse portions parallel with thickness T (730, 731), said transverse and longitudinal portions being formed from at least two fabrics, a first substantially sealing and semi-rigid fabric (77) ensuring that the distributor device keeps its shape during casting, and a second non-sealing fabric (78) allowing the passage and filtration of liquid, said first and second fabrics being bonded to each other without overlap or with overlap and no gap separating them, said first fabric continuously covering at least 30% of the surface of said wall portions (720, 721, 730, 731) and being positioned so that the liquid surface is in contact therewith over the entire section, Another object of the invention is a distributor used for semi-continuous casting of aluminum alloy slabs made of fabric comprising essentially carbon, having a lower face (76), an upper face defining the opening through which the molten metal is introduced (71) and a wall of substantially rectangular section, the wall comprising two longitudinal portions parallel with width W (720, 721) and two transverse portions parallel with thickness T (730, 731), said transverse and longitudinal portions being formed from at least two fabrics, a first substantially sealing and semi-rigid fabric (77) ensuring that the distributor device keeps its shape during casting, and a second non-sealing fabric (78) allowing the passage and filtration of liquid, said first and second fabrics being bonded to each other without overlap or with overlap and no gap separating them, said first fabric continuously covering at least 30% of the surface of said wall portions (720, 721, 730, 731) and being positioned so that the liquid surface is in contact therewith over the entire section.

DETAILED DESCRIPTION OF A PREFERRED EMBODIMENT

Unless otherwise stated, all information regarding the chemical composition of the alloys is expressed as a percentage by weight based on the total weight of the alloy. The expression 1.4 Cu means that the copper content expressed as a percentage by weight is multiplied by 1.4. Alloy designation is made in accordance with the regulations of The Aluminium Association, known to specialists in the field. Unless otherwise stated, the definitions of tempers listed in European standard EN 515 will apply.

Static tensile mechanical properties, in other words, the ultimate tensile strength $R_m$, the conventional yield stress at 0.2%, the elongation limit $R_{p0.2}$, and elongation at rupture A %, are determined by a tensile test according to NF EN ISO 6892-1, sampling and direction of testing being defined by EN 485-1.

Figure 1A:
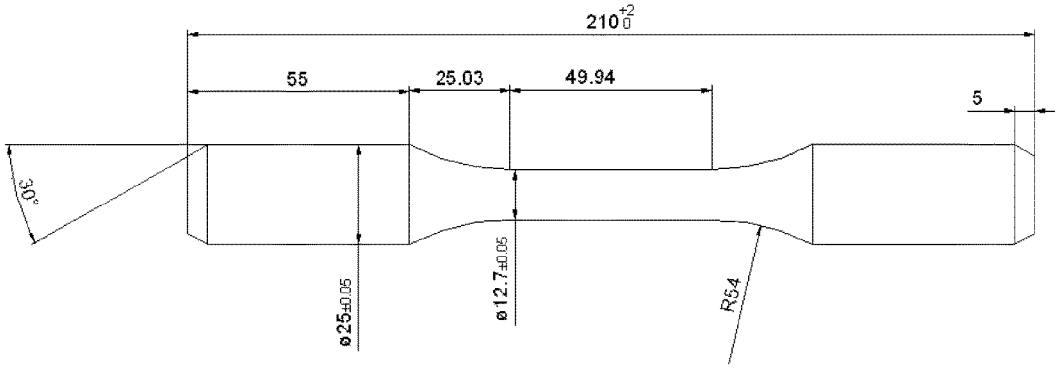
FIGS. 1*a* and 1*b* are diagrams of the test samples used for smooth (FIG. 1*a*) and notched (FIG. 1*b*) fatigue testing. Dimensions are given in mm.

Fatigue properties on smooth test samples were measured in ambient air at a maximum stress amplitude of 242 MPa, a frequency of 50 Hz, and a stress ratio of R=0.1, on test samples as shown in FIG. 1*a*, taken at mid-width and mid-thickness of plates in the LT direction. The test conditions are compliant with standard ASTM E466. The logarithmic mean of the results obtained is determined on at least four specimens.

Figure 1B:
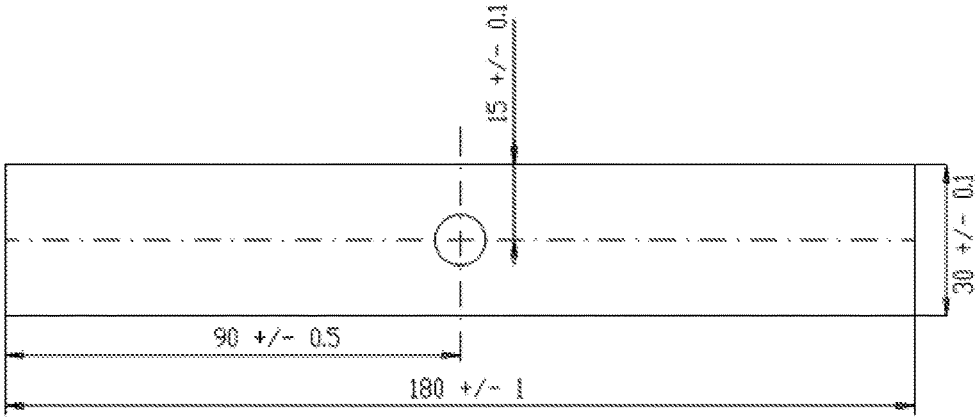

The fatigue properties of notched specimens are measured in ambient air for varying levels of stress, at a frequency of 50 Hz, and a stress ratio of R=0.1, on test specimens as shown in FIG. 1*b*, $K_t$=2.3, taken at the centre and mid-thickness of the plates in the direction L-T and T-L. The Walker equation was used to determine a maximum stress value representative of 50% of non-ruptures at 100,000 cycles. To do this, a fatigue quality index (IQF) is calculated for each point of the Wohler curve with the formula $$IQF = \sigma_{max}\left(\frac{N_0}{N}\right)^{1/n}$$

where $\sigma_{max}$ is the maximum stress applied to a given sample, N is the number of cycles to rupture, $N_0$ is 100,000 and n=−4.5. The IQF corresponding to the median, or 50% rupture for 100,000 cycles, is reported.

In the context of the invention, a wrought thick product is a product whose thickness is at least 6 mm. Preferably the thickness of the products according to the invention is at least 80 mm and preferably at least 100 mm. In one embodiment of the invention the thickness of the wrought products is at least 120 mm or preferably 140 mm. The thickness of the thick products according to the invention is typically at most 240 mm, generally at most 220 mm and preferably at most 180 mm.

Unless stated otherwise, the definitions of standard EN 12258 apply. In particular, a plate is according to the invention a rolled product of rectangular cross-section, whose uniform thickness is at least 6 mm and not more than 1/10th of the width.

As used herein, "structure element" or "structural element" of a mechanical construction refers to a mechanical part for which static and/or dynamic mechanical properties are particularly important for the performance of the structure, and for which a structure calculation is usually prescribed or performed. These are typically elements whose failure could endanger the safety of said construction, its users or other people. For an aircraft, these structural elements include the elements that make up the fuselage (such as the fuselage skin, stringers, bulkheads and circumferential frames), the wings (such as the wing skin, stringers or stiffeners, ribs and spars), and the tail unit, which is made up of horizontal and vertical stabilizers, and floor beams, seat tracks and doors.

Here, "the entire casting facility" refers to all devices for converting a metal in any form into a raw semi-finished product via the liquid phase. A casting facility may include many devices such as one or more furnaces needed for melting metal ("smelters") and/or keeping it at a given temperature ("holding furnace") and/or operations for preparing the liquid metal and adjusting the composition ("production furnace"), one or more vessels (or "ladles") for removing impurities dissolved and/or suspended in the molten metal; this treatment may involve filtering the liquid metal through a filter medium in a "filter bag" or introducing into the bath a "treatment" gas that may be inert or reactive in a "reaction vessel", a device for solidifying the liquid metal (or "casting machine"), by semi-continuous direct chill vertical casting into a casting pit, which may include devices such as a mould (or "ingot mould"), a device for supplying liquid metal (or "spout") and a cooling system, these furnaces, vessels and solidification devices being interconnected by transfer devices or channels called "troughs" in which the liquid metal may be carried.

The present inventors have surprisingly found that wrought thick products made of aluminum copper lithium alloy can be obtained that have improved fatigue performance by preparing these plates using the following method.

In the first step, a bath of molten alloy metal is prepared comprising, as a percentage by weight, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % t for Mn, 0.05 to 0.3 wt % for Cr and for Sc, 0.05 to 0.5 wt % Hf and 0.01 to 0.15% wt % for Ti, Si≤0.1; Fe≤0.1; others≤0.05 each and ≤0.15 in total, remainder aluminium.

An advantageous alloy for the method according to the invention comprises, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0-0.7; Zn≤0.25; Si≤0.08; Fe≤0.10; others≤0.05 each and ≤0.15 in total, remainder aluminium.

Advantageously, the copper content is at least 3.2% by weight. The lithium content is preferably between 0.85 and 1.15% by weight and preferably between 0.90 and 1.10% by weight. The magnesium content is preferably between 0.20 and 0.6% by weight. Simultaneous addition of manganese and zirconium is generally advantageous. Preferably, the manganese content is between 0.20 and 0.50% by weight and the zirconium content is between 0.06 and 0.14% by weight. The silver content is preferably between 0.20 and 0.7% by weight. It is advantageous for the silver content to be at least 0.1% by weight. In one embodiment of the invention, the silver content is at least 0.20% by weight. In an aspect, the silver content is at most 0.5% by weight. In one embodiment of the invention, the silver content is limited to 0.3% by weight. Preferably, the silicon content is at most 0.05% by weight and the iron content is at most 0.06% by weight. Advantageously, the titanium content is between 0.01 and 0.08% by weight. In one embodiment of the invention, the zinc content is at most 0.15% by weight.

A preferred aluminium-copper-lithium alloy is alloy AA2050.

This molten metal bath is prepared in a furnace in the casting facility. It is known, for example from U.S. Pat. No. 5,415,220 which is hereby incorporated by reference in its entirety, that molten salts containing lithium can be used, such as KCl/LiCl mixtures in the smelter to passivate the alloy while it is being transferred to the casting facility. However, the present inventors have obtained excellent fatigue properties for thick plates without the use of molten salt containing lithium in the smelter, but by keeping a low-oxygen atmosphere in this smelter, and they believe that the presence of salt in the smelter could, in some cases, have a detrimental effect on the fatigue properties of thick wrought products. Therefore, in an aspect, the disclosure provides for a method of manufacturing thick plate alloys described herein without the use of molten salt containing lithium. In an advantageous embodiment no molten salt is used throughout the casting facility. Preferably, an oxygen content less than 0.5% by volume and preferably less than 0.3% by volume is maintained in the furnace(s) of the casting facility. However, an oxygen content of at least 0.05% by volume and even at least 0.1% by volume can be tolerated in the furnace(s) of the casting facility, which is advantageous especially for the economic aspects of the method. Advantageously the furnace(s) of the casting facility are induction furnaces. The present inventors have found that this type of furnace is advantageous despite the mixing generated by induction heating.

This bath of molten metal is then treated in a reaction vessel and a filter bag, particularly so that its hydrogen content is less than 0.4 ml/100 g and preferably less than 0.35 ml/100 g. This bath of molten metal is then treated in a reaction vessel and a filter bag, particularly so that its hydrogen content is less than 0.4 ml/100 g and preferably less than 0.35 ml/100 g. The hydrogen content of the molten metal is measured by a commercially available appliance such as that sold under the trademark ALSCAN™, known to those skilled in the art, the probe being kept under a nitrogen sweep. Preferably the oxygen content of the atmosphere in contact with the molten metal bath in the smelter during the degassing, filtration steps is less than 0.5% by volume and preferably less than 0.3% by volume. Preferably, the oxygen content of the atmosphere in contact with the molten metal bath is less than is less than 0.5% by volume and preferably less than 0.3% by volume for the entire casting facility. However, an oxygen content of at least 0.05% by volume and even at least 0.1% by volume can be tolerated in the entire casting facility, which is advantageous especially for the economic aspects of the method.

Figure 2:
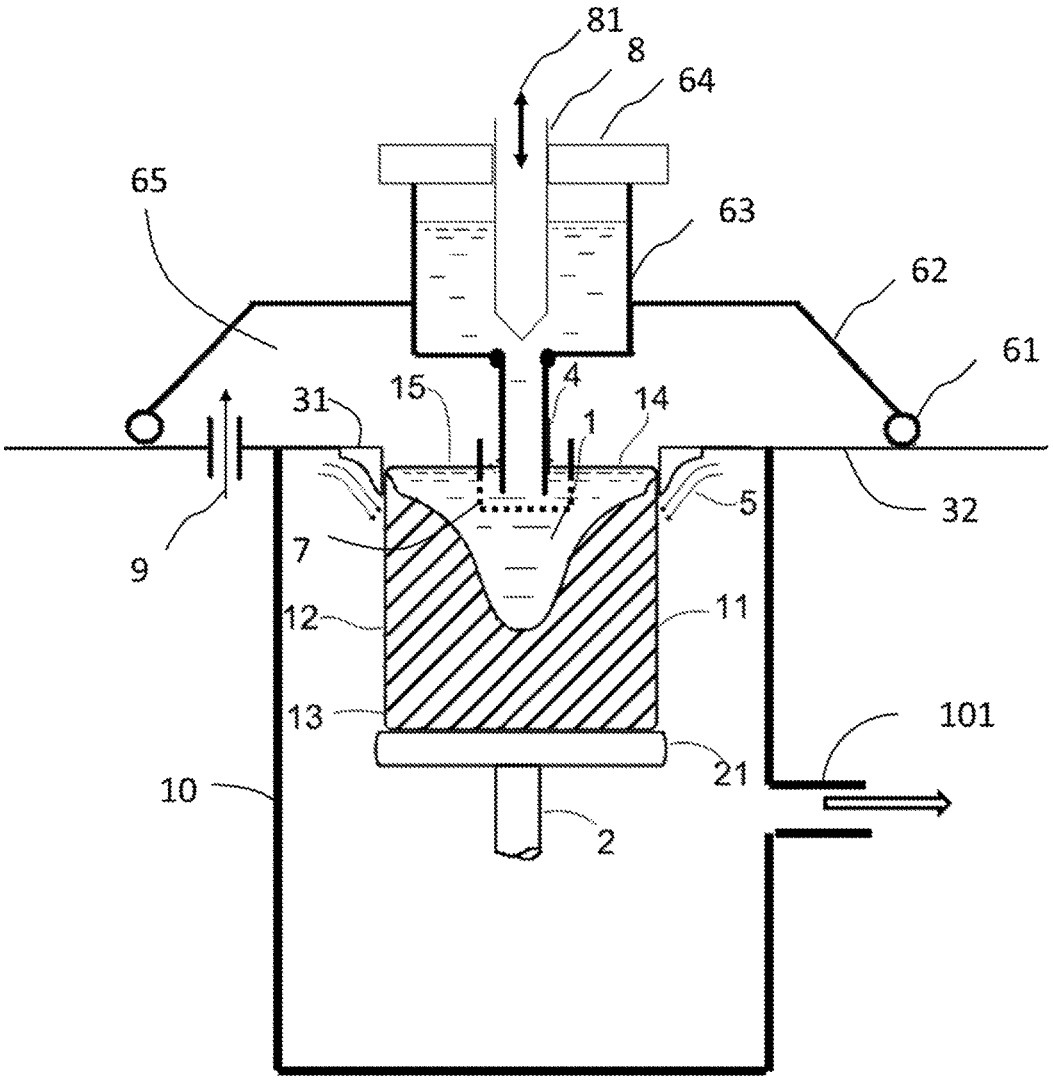
FIG. 2 is a general diagram of the solidification device used in one embodiment of the invention.

The molten metal bath is then solidified as a slab. A slab is a block of aluminium of substantially parallelepipedal shape, of length L, width W and thickness T. The atmosphere above the liquid surface is controlled during solidification. An example of a device for controlling the atmosphere above the liquid surface during solidification is shown in FIG. 2.

In this example of a suitable device, the molten metal from a trough (63) is introduced into a spout (4) controlled by a control pin (8) that can move upwards and downwards (81) in an ingot mould (31) placed on a bottom block (21). The aluminium alloy is solidified by direct cooling (5). The aluminium alloy (1) has at least one solid surface (11, 12, 13) and at least one liquid surface (14, 15). An elevator (2) keeps the level of the liquid surface (14, 15) substantially constant. A distributor device (7) is used to distribute the molten metal. A lid (62) covers the liquid surface. The lid may comprise seals (61) to ensure a leak tight seal with the casting table (32). The molten metal in the trough (63) may advantageously be protected by a lid (64). An inert gas (9) is introduced into the chamber (65) defined between the lid and the casting table. The inert gas is preferably selected from rare gases, nitrogen and carbon dioxide or mixtures of these gases. A preferred inert gas is argon. The oxygen content is measured in the chamber (65) above the liquid surface. The inert gas flow rate can be adjusted to achieve the desired oxygen content. However it is advantageous to maintain sufficient suction in the casting pit (10) by means of a pump (101). The present inventors found that there is not usually sufficient sealing between the ingot mould (31) and the solidified metal (5) which leads to a diffusion of the atmosphere from the casting pit (10) to the chamber (65). Advantageously, the suction of the pump (101) is such that the pressure in the containment (10) is less than the pressure in the chamber (65), which may be preferably obtained by imposing a speed for the atmosphere through the open areas of the casting pit of at least 2 m/s and preferably at least 2.5 m/s. Typically the pressure in the chamber (65) is close to atmospheric pressure and the pressure in the containment (10) is below atmospheric pressure, typically 0.95 times atmospheric pressure. With the method according to the invention an oxygen content of less than 0.5% by volume and preferably less than 0.3% by volume is maintained in the chamber (65), by means of the devices described.

Figure 3:
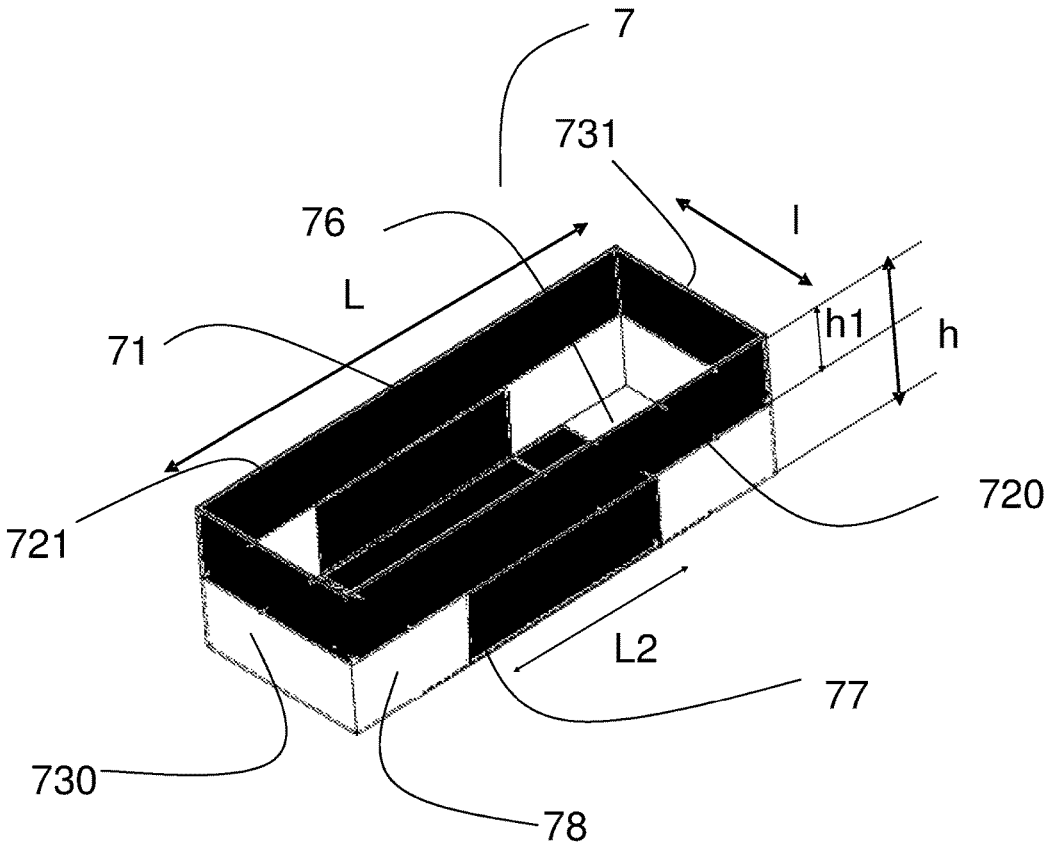
FIG. 3 is a general diagram of the distributor device used in the method according to the invention.
Figure 4:
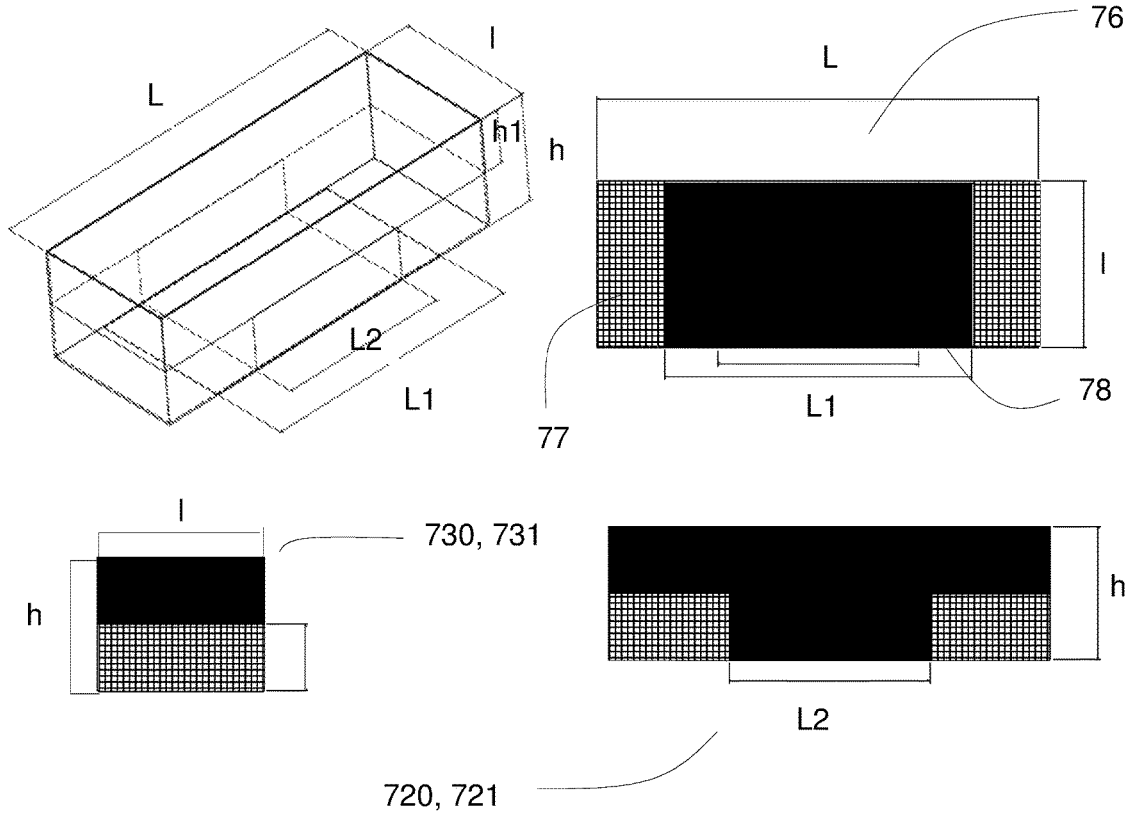
FIG. 4 shows representations of the bottom and side and longitudinal wall portions of the distributor device according to one embodiment of the invention.

An example of the distributor device (7) for the method according to the invention is shown in FIGS. 3 and 4. The distributor device according to the invention is made of fabric comprising essentially carbon, it comprises a lower face (76), a typically empty upper face defining the opening through which the molten metal is introduced (71) and a wall of substantially rectangular section typically substantially constant and of height h typically substantially constant, the wall comprising two longitudinal portions parallel with width W of the slab (720, 721) and two transverse portions parallel with thickness T of the slab (730, 731), said transverse and longitudinal portions being formed of at least two fabrics, a first substantially sealing and semi-rigid fabric (77) ensuring that the distributor device keeps its shape during casting and a second non-sealing fabric (78) allowing the passage and filtration of liquid, said first and second fabrics being bonded to each other without overlap or with overlap and no gap separating them, said first fabric continuously covering at least 30% of the surface of said wall portions (720, 721, 730, 731) and being positioned so that the liquid surface is in contact therewith over the entire section. As the first and second fabrics are stitched to each other without overlap or with an overlap and without a gap between them, i.e. in contact, the molten metal cannot pass through the first fabric and be deflected by the second fabric as is the case for example in a combo-bag as described in application WO 99/44719 FIGS. 2 to 5. Through the support provided by the first fabric, the distributor device is semi-rigid and does not deform substantially during casting. In an advantageous embodiment, the first fabric has a height h1 as measured from the upper face on the circumference of the wall (720, 721, 730, 731) such that h1≥0.3 h and preferably h1≥0.5 h, where h is the total height of the wall of the distributor device.

As the liquid surface is in contact with said first sealing fabric the liquid metal passes through the distributor device only under the liquid surface in certain directions of each part of the wall. Preferably the height of the wall immersed in the liquid metal (721, 720, 730, 731) of the distributor device (7) covered by the first fabric is at least 20%, preferably 40% and ideally 60% of the total height of the immersed wall.

FIG. 4 shows the bottom and longitudinal portions of the wall. The bottom (76) is typically covered by the first and/or second fabric. Advantageously, the first fabric is located at least in the central part of the bottom (76) over a length L1 and/or in the central part of the longitudinal portions (720) and (721) over the entire height h and over a length L2.

Advantageously, the surface portion covered by the first fabric is between 30 and 90% and preferably between 50 and 80% for the longitudinal portions (720) and (721), and/or between 30 and 70% and preferably between 40 and 60% for the lateral portions (730, 731) and/or between 30 and 100% and preferably between 50 and 80% for the bottom (76).

It is advantageous for length L1 of the first fabric located in the bottom (76) to be greater than length L2 of the first fabric in the portion of the longitudinal walls (720) and (721) in contact with the bottom.

The present inventors believe that the geometry of the distributor device makes it possible to improve the quality of the liquid metal flow, reduce turbulence and improve temperature distribution.

The first fabric and the second fabric are preferably obtained by weaving wire comprising essentially carbon. Woven graphite wire is particularly advantageous. The fabrics are typically sewn to each other. Instead of a first and second fabric, it is also possible to use a single fabric distributor device having at least two more or less dense weaving zones. For ease of weaving, it is advantageous for the wire containing carbon to be coated with a layer that facilitates sliding. This layer may, for example, contain a fluorinated polymer such as Teflon or polyamide such as xylon.

The first fabric is substantially sealing. Typically, this is a fabric with a mesh size of less than 0.5 mm, preferably less than 0.2 mm. The second fabric is not sealing and allows molten metal to pass through. Typically, this is a fabric with a mesh size of between 1 and 5 mm, preferably 2 to 4 mm. In one embodiment of the invention, the first fabric locally covers the second fabric, while being in close contact so as to leave no gap between the two fabrics.

Advantageously, the slab obtained in this way is then worked to obtain a wrought product. The slab obtained in this way is then homogenized before or after being optionally machined to obtain a shape that can be hot worked. In one embodiment, the slab is machined in the form of a rolling ingot to be then hot-worked by rolling. In another embodiment, the slab is machined in the form of a forging blank to be then hot-worked by forging. In yet another embodiment the slab is machined in the form of billets to be then hot-worked by extrusion. Preferably homogenization is carried out at a temperature between 470 and 540° C. for a period of between 2 and 30 hours.

Said homogenized shape is then hot-worked and optionally cold-worked to obtain a wrought product. The hot-working temperature is advantageously at least 350° C. and preferably at least 400° C. The hot-working and optionally cold-working ratio, i.e. the ratio between firstly the difference between the initial thickness before working, but after any machining, and the final thickness, and secondly the initial thickness, is less than 85% and preferably less than 80%. In an embodiment the deformation ratio during working is less than 75% and preferably less than 70%.

The wrought product so obtained then undergoes solution heat-treatment and quenching. The solution heat-treatment temperature is advantageously between 470 and 540° C. and preferably between 490 and 530° C. and the time depends on the thickness of the product. Optionally said wrought product that has undergone solution heat treatment is stress-relieved by plastic deformation with a deformation of at least 1%. In the case of rolled products it is advantageous to stress-relieve by controlled stretching said wrought product that has undergone solution heat-treatment with a permanent elongation of at least 1% and preferably between 2 and 5%.

Finally said solution heat-treated and optionally stress relieved product is subjected to aging. Aging is carried out in one or more stages at a temperature preferably between 130 and 160° C. for a period of 5 to 60 hours. Preferably, a T8 temper, such as T851, T83, T84, or T85 is obtained after aging.

The wrought products obtained by the process according to the invention have advantageous properties.

The fatigue logarithmic mean of wrought products whose thickness is at least 80 mm, obtained by the method according to the invention, measured at mid-thickness in the LT direction on smooth test samples according to FIG. 1*a* at a maximum stress amplitude of 242 MPa, a frequency of 50 Hz and a stress ratio R=0.1 is at least 250,000 cycles; advantageously the fatigue property is obtained for wrought products obtained by the method according to the invention with a thickness of at least 100 mm, or preferably at least 120 mm or even at least 140 mm.

The wrought products according to the invention of thickness at least 80 mm also exhibit advantageous fatigue properties for notched test samples, and the fatigue quality index FQI obtained on notched test samples Kt=2.3 according to FIG. 1*b* at a frequency of 50 Hz in ambient air with a value R=0.1 is at least 180 MPa and preferably at least 190 MPa in the T-L direction.

Moreover, the products obtained by the method according to the invention have advantageous static mechanical properties. For wrought products whose thickness is at least 80 mm comprising, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0 to 0.7; Zn≤0.25; Si≤0.08; Fe≤0.10; others≤0.05 each and ≤0.15 in total, remainder aluminium, the yield stress measured at a quarter thickness in the L direction is at least 450 MPa and preferably at least 470 MPa and/the ultimate tensile strength measured is at least 480 MPa and preferably at least 500 MPa and/or elongation is at least 5% and preferably at least 6%.

The wrought products obtained by the method according to the invention can advantageously be used to produce structural elements, preferably structural elements for aircraft. Preferred aircraft structural elements are spars, ribs or frames. The invention is particularly advantageous for components of complex shape obtained by integral machining, used in particular for the manufacture of aircraft wings, as well as for any other use for which the properties of the products according to the invention are advantageous.

EXAMPLE

In this example, AA2050 alloy thick plates were prepared. AA2050 alloy slabs were cast by semi-continuous vertical direct chill casting.

The alloy was prepared in a smelter. For examples 1 to 7 a KCL/LiCl mixture was used on the surface of the liquid metal in the smelter. For examples 8 to 9 no salt was used in the smelter. For examples 8 to 9 the atmosphere in contact with the liquid metal had an oxygen content of less than 0.3% by volume for the whole casting facility. The casting facility included a hood arranged above the casting pit to limit the oxygen content. For tests 8 and 9 a suction system (101) was additionally used, such that the pressure in the containment (10) was lower than the pressure in the chamber (65) and such that the velocity of the air through the open surfaces of the casting pit was at least 2 m/s. The oxygen content was measured using an oxygen analyzer during casting. In addition, the hydrogen content in the liquid aluminum was measured using an Alscan™ type probe with nitrogen scanning. Two types of molten metal distributor device were used. A first distributor device of the "Combo Bag" type as described for example in FIGS. 2-6 of international application WO99/44719 which is hereby incorporated by reference in its entirety, but made from a fabric comprising of carbon, referred to below as "distributor device A", and a second distributor device such as described in FIG. 3 below, referred to as "distributor device B", is made from graphite wire fabric.

The casting conditions for the various tests are given in table 1.

TABLE 1

Casting conditions for the various tests

| Test | H2 [ml/100 g] | O2 measured above the casting pit (% by volume) | Distributor device |
|---|---|---|---|
| 1 | 0.41 | 0.3 | A |
| 2 | 0.43 | 0.1 | A |
| 3 | 0.37 | 0.1 | A |
| 4 | 0.33 | 0.1 | A |
| 5 | 0.35 | 0.4 | A |
| 6 | 0.38 | 0.3 | A |
| 7 | 0.47 | 0.7 | B |
| 8 | 0.34 | 0.1 | B |
| 9 | 0.29 | 0.1 | B |

The slabs were homogenized for 12 hours at 505° C., machined to a thickness of about 365 mm, hot-rolled to obtain plates with a final thickness of between 154 and 158 mm, solution heat-treated at 504° C., hardened and stress relieved by controlled stretching with a permanent elongation of 3.5%. The plates obtained in this way underwent aging for 18 hours at 155° C.

The static mechanical properties and fracture toughness were characterized at a quarter thickness. The static mechanical properties and fracture toughness are given in Table 2.

TABLE 2

Mechanical properties

| Test | Thickness [mm] | Rm (L) MPa | Rp0.2 (L) MPa | A % (L) |
|---|---|---|---|---|
| 1 | 158 | 528 | 495 | 6.5 |
| 2 | 155 | 538 | 507 | 7.0 |
| 3 | 155 | 525 | 493 | 8.3 |
| 4 | 158 | 528 | 497 | 7.0 |
| 5 | 158 | 529 | 495 | 6.0 |
| 6 | 158 | 527 | 496 | 6.8 |
| 7 | 154 | 514 | 486 | 8.3 |
| 8 | 158 | 533 | 502 | 6.3 |
| 9 | 158 | 542 | 512 | 5.8 |

Fatigue properties were characterized on smooth test samples and on notched test samples for some samples taken at mid-thickness.

For smooth fatigue characterizations, four test samples, shown as a diagram in FIG. 1*a*, were tested at mid-thickness and mid-width in the LT direction, the test conditions being $\sigma$=242 MPa, R=0.1. Some tests were stopped after 200,000 cycles and other tests were stopped after 300,000 cycles.

Figure 6A:
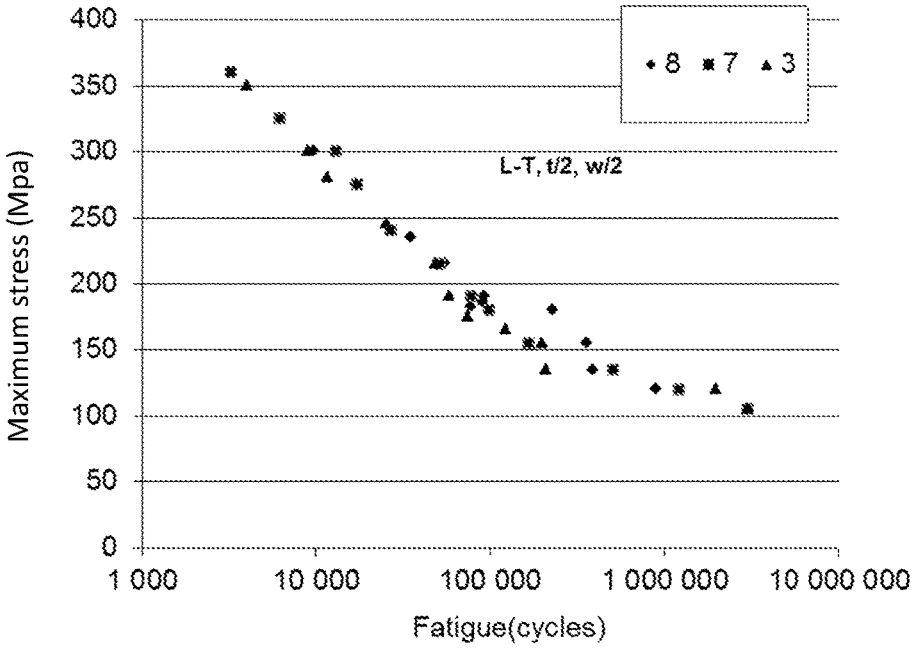
FIGS. 6*a* and 6*b* show the Wöhler curves obtained with tests 3, 7 and 8 in direction L-T (FIG. 6*a*) and T-L (FIG. 6*b*).
Figure 6B:
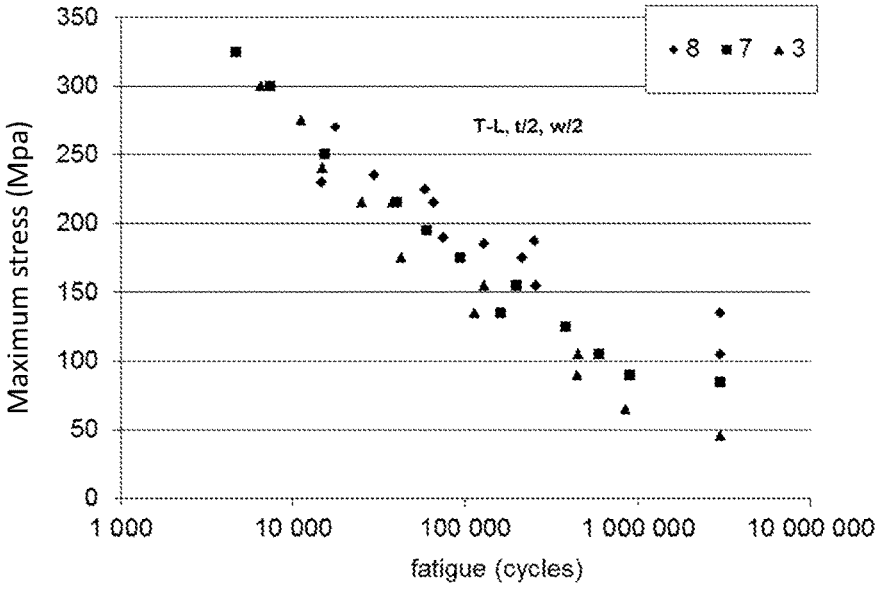

For notched fatigue characterizations, the test piece shown in FIG. 1*b*, whose $K_t$ value is 2.3, was used. The test samples were tested at a frequency of 50 Hz in ambient air with R=0.1. The corresponding Wohler curves are shown in FIGS. 6*a* and 6*b*. The fatigue quality index IQF was calculated.

TABLE 3

Results of fatigue tests

| | Results for smooth fatigue (number of cycles) | | | | | Results for notched fatigue IQF (MPa), 50% rupture for 100,000 cycles | |
|---|---|---|---|---|---|---|---|
| Test | Test piece 1 | Test piece 2 | Test piece 3 | Test piece 4 | Logarithmic mean | L-T | T-L |
| 1 | 101423 | 101761 | 116820 | 118212 | 109263 | | |
| 2 | 102570 | 140030 | 152120 | 178860 | 140600 | | |
| 3 | 112453 | 163422 | 152620 | 167113 | 147138 | 175 | 152 |
| 4 | 101900 | 110300 | 139400 | 144100 | 122580 | | |
| 5 | 93400 | 105000 | 112600 | 129900 | 109439 | | |
| 6 | 114000 | 116500 | 188100 | 195000 | 148564 | | |
| 7 | 192300 | >200000 | 189600 | >200000 | >195400 | 183 | 168 |
| 8 | >300000 | >300000 | >300000 | >300000 | >300000 | 186 | 196 |
| 9 | >300000 | >300000 | >300000 | >300000 | >300000 | | |

Figure 5A:
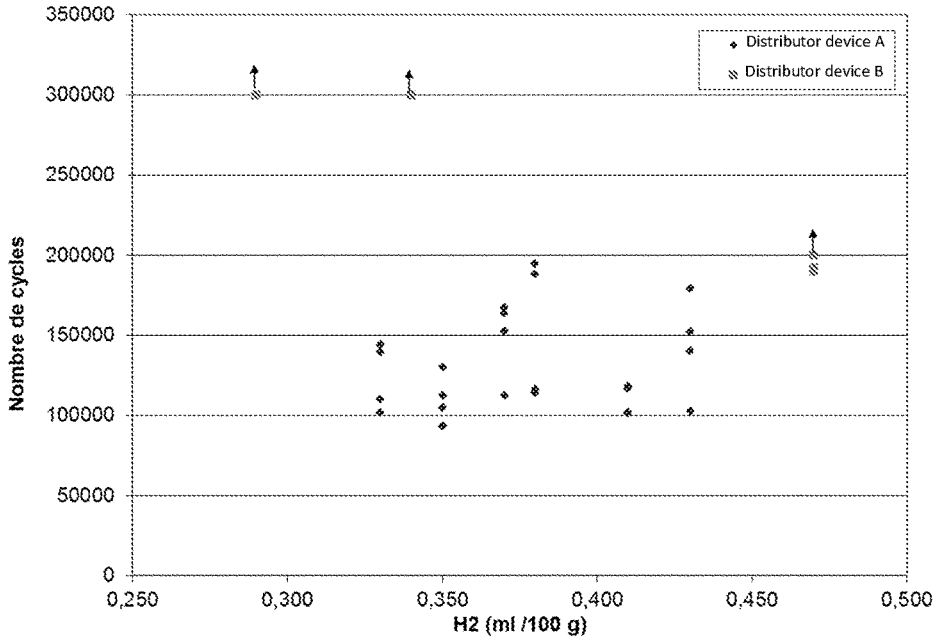
FIGS. 5*a* and 5*b* show the relationship between smooth fatigue performance and the hydrogen content of the bath of molten metal during solidification (FIG. 5*a*) or the oxygen content measured above the liquid surface during solidification (FIG. 5*b*).
Figure 5B:
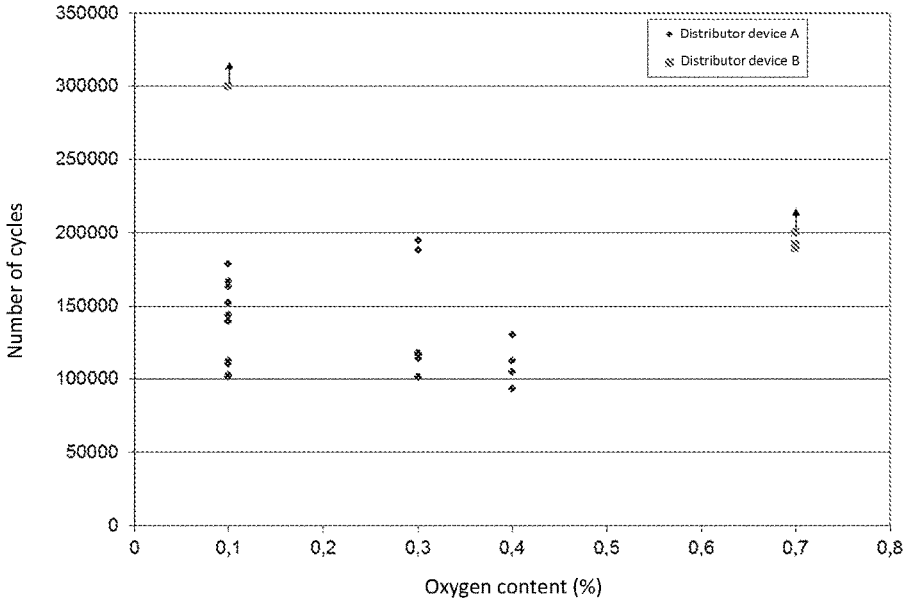

The combination of a hydrogen content of less than 0.4 ml/100 g, an oxygen content measured above the liquid surface of less than 0.3% by volume, and distributor device B gives a high level of fatigue performance. These results are shown in FIGS. 5*a* and 5*b*.

The invention claimed is:

1. A method of manufacturing an aluminum alloy product comprising (a) preparing a bath of molten alloy metal comprising, as a percentage by weight, Cu: 2.0-6.0; Li: 0.5-2.0; Mg: 0-1.0; Ag: 0-0.7; Zn 0-1.0; and at least one element selected from Zr, Mn, Cr, Sc, Hf and Ti, the amount of said element, if selected, being 0.05 to 0.20 wt % for Zr, 0.05 to 0.8% wt % for Mn, 0.05 to 0.3 wt % for Cr and for Sc, 0.05 to 0.5 wt % Hf and 0.01 to 0.15% wt % for Ti, Si≤0.1; Fe≤0.1; others≤0.05 each and ≤0.15 in total, (b) casting said alloy by vertical semi-continuous casting to obtain a slab of thickness T and width W so that upon solidification, the hydrogen content of said molten metal bath is less than about 0.4 ml/100 g, the oxygen content measured above a liquid surface is less than about 0.5% by volume, a distributor device used for casting is made of fabric comprising essentially carbon; said distributor device comprises a lower face, an upper face defining the opening through which the molten metal is introduced and a wall of substantially rectangular section, the wall comprising two longitudinal portions parallel with width W and two transverse portions parallel with thickness T, said transverse and longitudinal portions being formed from at least two fabrics, a first substantially sealing and semi-rigid fabric ensuring that the distributor device keeps shape during casting, and a second non-sealing fabric allowing the passage and filtration of liquid, said first and second fabrics being bonded to each other without overlap or with overlap and no gap separating them, said first fabric continuously covering at least 30% of the surface of wall portions and being positioned so that the liquid surface is in contact therewith over an entire section.

2. The method according to claim 1 wherein the oxygen content of the atmosphere in contact with the molten metal bath in a smelter during degassing, filtration is less than 0.5% by volume.

3. The method according to claim 2, wherein the oxygen content of the atmosphere in contact with the molten metal bath is less than 0.5% by volume for an entire casting facility.

4. The method according to claim 1 wherein a lid covers the liquid surface during solidification, wherein said lid comprises seals to ensure a leak tight seal with a casting table and wherein an inert gas is introduced into a chamber defined between the lid and the casting table and wherein suction is maintained in a casting pit by means of a pump.

5. The method according to claim 4, wherein pressure within the casting pit is less than pressure in the chamber.

6. The method according to claim 1 wherein a molten salt containing lithium is not used throughout an entire casting facility.

7. The method according to claim 1 in which the first fabric of said distributor device has a height h1 as measured from the upper face on the circumference of a wall such that h1≥0.3 h, where h is the total height of a wall of the distributor device.

8. The method according to claim 7, wherein h1≥0.5 h.

9. The method according to claim 1 in which the height of a wall immersed in liquid metal of the distributor device covered by the first fabric is selected from the group consisting of at least 20%, 40%, and 60% of the total height of the immersed wall.

10. The method according to claim 1 in which the first fabric covers from 30 to 90% of a surface of the longitudinal portions and/or from 30 to 70% of a surface of the transverse portions and/or from 30 to 100% of a surface of the lower face.

11. The method according to claim 10 in which the first fabric covers from 50 to 80% of a surface of the longitudinal portions and/or from 40 to 60% of a surface of the transverse portions and/or from 50 to 80% of a surface of the lower face.

12. The method according to claim 1 further comprising after (a) and (b), (c) homogenizing said slab before or after optionally machining to obtain a shape that can be hot-worked, (d) hot-working said homogenized shape and optionally cold-working to obtain a wrought product, (e) solution heat-treating and quenching said wrought product, (f) optionally stress-relieving said wrought product that has undergone solution heat treatment by plastic deformation with a deformation of at least 1%, (g) aging said solution heat-treated and optionally stress relieved product.

13. The method according to claim 12 wherein said hot working and/or cold-working is performed by extrusion, rolling and/or forging.

14. The method according to claim 12, wherein said wrought product has a thickness of at least 80 mm.

15. The method according to claim 12 wherein a deformation ratio during (d) is lower than 85%.

16. The method according to claim 1 wherein the alloy comprises, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0-0.7; Zn≤0.25; Si≤0.08; Fe≤0.10; others≤0.05 each and ≤0.15 in total.

17. The method according to claim 1, wherein the alloy comprises, as a percentage by weight, Cu: 3.2-3.9; Li: 0.85-1.15; Mg: 0.20 to 0.6, at least one element selected from Zr, Mn and Ti, the amount of said element, if selected, is from 0.06 to 0.14 wt % for Zr, 0.20 to 0.50 wt % for Mn and 0.01 to 0.08% by weight for Ti; Ag: 0.1-0.5; Zn≤0.15; Si≤0.05; Fe≤0.06; others≤0.05 each and ≤0.15 in total.

18. The method according to claim 1, wherein the alloy consists of, as a percentage by weight, Cu: 3.0-3.9; Li: 0.7-1.3; Mg: 0.1 to 1.0, at least one element selected from Zr, Mn and Ti, the amount of said element, if selected, is from 0.06 to 0.15 wt % for Zr, 0.05 to 0.8 wt % for Mn and 0.01 to 0.15% by weight for Ti; Ag: 0-0.7; Zn≤0.25; Si≤0.08; Fe≤0.10; others≤0.05 each and ≤0.15 in total.

* * * * *